US005997368A

United States Patent [19]

Mello et al.

[11] Patent Number: 5,997,368

[45] Date of Patent: Dec. 7, 1999

[54] CONNECTOR FOR CONNECTING A CONDUCTOR TO A STRUCTURAL MEMBER

[75] Inventors: Keith F. Mello, Manchester; H. Thomas Nelson, Bedford, both of N.H.; Gerhard P. Schwebler, Kennebunk, Me.

[73] Assignee: Framatome Connectors USA, Inc., Fairfield, Conn.

[21] Appl. No.: 08/958,831

[22] Filed: Oct. 28, 1997

[51] Int. Cl.[6] ..... H01R 4/10

[52] U.S. Cl. ..... 439/877; 174/94 S; 191/44

[58] Field of Search ..... 439/92, 100; 174/84 S, 174/94 R, 94 S; 191/44, 44.1

[56] References Cited

U.S. PATENT DOCUMENTS 2,956,108 10/1960 Brenner ..... 174/94 R
2,964,585 12/1960 Nilsson et al. ..... 174/94 R
3,341,670 9/1967 Martin et al. ..... 191/44.1
5,036,164 7/1991 Schrader et al. ..... 174/94 R
5,240,423 8/1993 Morrison ..... 439/92

*Primary Examiner*—Paula Bradley
*Assistant Examiner*—Katrina Davis
*Attorney, Agent, or Firm*—Perman & Green, LLP

[57] ABSTRACT

A connector having a frame with an upper arm and a lower arm cantilevered from a center section to form a channel adapted to receive a section of a structural steel member. The frame has a conductor receiving area to receive a conductor therein. The conductor receiving area is located so that when the upper arm and the lower arm are compressed to grip the section of the structural steel member received in the channel, the conductor located in the conductor receiving area is crimped to the frame.

10 Claims, 4 Drawing Sheets

CONNECTOR FOR CONNECTING A CONDUCTOR TO A STRUCTURAL MEMBER

BACKGROUND OF THE INVENTION

1. Field of the Invention

The present invention relates to a connector and, more particularly, to a connector for crimping a conductor to a structural member.

2. Prior Art

Compression connectors are generally well known in the art. One example is U.S. Pat. No. 5,036,164 which describes a compression ground connector for connecting one or more taps from a single connector to an installation requiring grounding. Another example is U.S. Pat. No. 5,240,423 which shows a grounding connector capable of being clamped to a tapered metallic flange of an I-beam.

SUMMARY OF THE INVENTION

In accordance with a first embodiment of the present invention, a connector is provided. The connector has a frame with an upper arm and a lower arm cantilevered from a center section to form a channel adapted to receive a section of a structural steel member. The frame has a conductor receiving area to receive a conductor therein. The conductor receiving area is located so that when the upper arm and the lower arm are deformed to clasp the section of the structural steel member received in the channel, the conductor located in the conductor receiving area is crimped to the frame.

In accordance with a second embodiment of the present invention, a connector is provided. The connector comprises a body and a conductor pigtail. The body comprises a block section with a pair of cantilevers extending from the block section. The conductor pigtail has a proximal end located in a recess in the body. The body is crimped to a flange section of a structural steel member by compressing the cantilevers against the flange section inserted therebetween. When the body is crimped to the flange section, the proximal end of the conductor pigtail is crimped within the recess in the body in which the proximal end is located.

In accordance with a third embodiment of the present invention, a connector is provided. The connector has a frame with an upper arm and a lower arm cantilevered from a center section to a form a generally U-shaped channel adapted to receive a section of a structural steel member. The frame has a conductor receiving area to receive a conductor therein. The conductor receiving area is located so that when the upper arm and lower arm are deformed to clasp the section of the structural steel member received in the channel, the conductor located in the conductor receiving area is crimped to the frame. The upper arm and lower arm of the channel have an interior surface forming opposite sides of the channel. One of the opposite sides of the channel is angled relative to the other so that the channel has a general funnel shape cross section.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figures 1, 2:
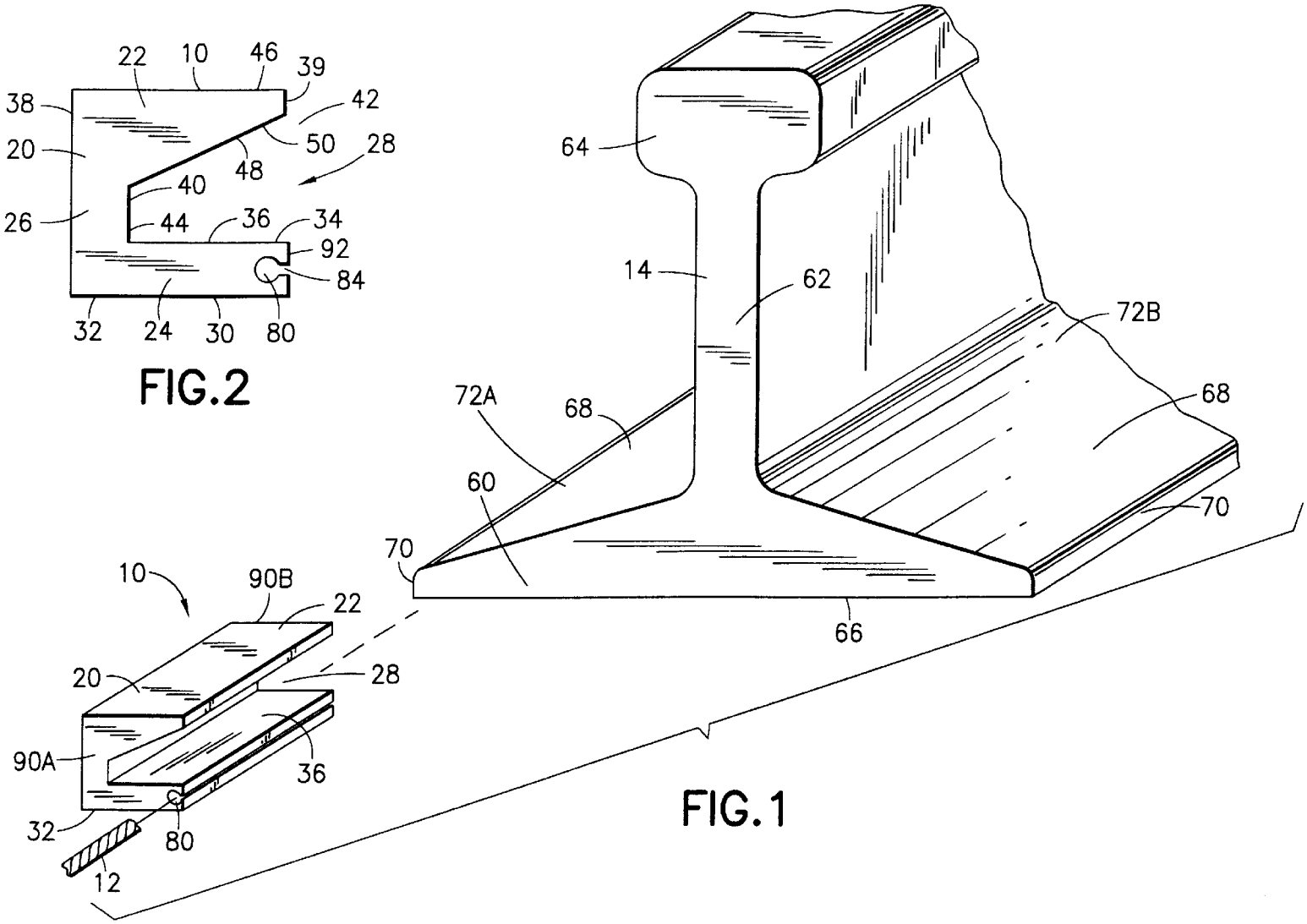
FIG. 1 is an exploded perspective view of a connector incorporating features of the present invention for attaching a conductor to a portion of a railroad rail.
FIG. 2 is an elevational side view of the connector shown in FIG. 1.

Referring to FIG. 1, there is shown an exploded perspective view of a connector 10 incorporating features of the present invention. Although the present invention will be described with reference to the embodiments shown in the drawings, it should be understood that that the present invention can be embodied in various different types of electrical connectors. In addition, any suitable size, shape or type of elements or materials could be used.

Still referring to FIG. 1, the connector 10 is used to mechanically and electrically connect a grounding conductor 12 to a railroad rail member 14. The conductor 12 is inserted into the connector 10. The connector 10 is then crimped or compressed onto a portion of the railroad rail member 14. The connector 10 is thus mechanically held to the railroad rail member 14. This mechanical connection also electrically connects the connector 10 to the railroad rail member 14. When the connector 10 is crimped to the rail member 14, the conductor 12 is crimped to the connector 10. This mechanically and electrically connects the conductor 12 to the connector 10. Thus, the conductor 12 is connected to the connector 10 and the connector 10 is connected to the railroad rail member 14 in one crimping stroke Consequently, the conductor 12 is mechanically and electrically connected to the railroad rail member 14, by the connector 10. Preferably, the conductor 12 is grounded. Thus, the rail 14 becomes grounded. The rail member 14 is ground by the conductor 12 with one crimping motion.

Referring also to FIG. 2, the connector 10 has a frame 20 made from a malleable electrically conducting metal. Preferably, the frame 20 is a one-piece member. The frame 20 has an upper arm 22 and a lower arm 24 cantilevered from a central web section 26 to form a generally "U" shaped channel 28. The lower arm 24 is substantially flat. The lower arm 24 has an external surface 30 forming a seating surface 32 of the connector 10. The inner surface 34 of the lower arm 24 forms a lower side 36 of the channel 28.

The web 26 extends between the upper arm 22 and lower arm 24 at a rear end 38 of the frame 20. The web 26 is substantially perpendicular to the lower arm 24. The face 40 of the web 26 facing the opening 42 of the channel 28 is the bottom 44 of the channel 28. The upper arm 22 has a tapered cross-section. The outer surface 46 of the upper arm 22 is substantially flat and generally parallel with the seating surface 32 of the connector 10. The inner surface 48 of the upper arm 22 forms the upper side 50 of the channel 28. The upper side 50 slopes upwards from the bottom 44 of the channel 28 forward to the front end 39 of the frame 20. Hence, the channel 28 has a taper which narrows the channel 28 from its opening 42 to the bottom 44. The taper of the channel 28 in the connector 10 generally conforms to the taper of the foot flange 60 of the railroad rail member 14; a portion of which is received in the channel 28 (see FIG. 3). The railroad rail member 14 has a foot flange 60 supporting a center web 62 with a rail head 64. The foot flange 60 has a substantially flat lower seating surface 66. The upper surfaces 68 of the foot flange 60 slope downward from the web 62 to the toes 70 of the foot flange 60. The slope of the upper surfaces 68 of the foot flange 60 conform to the slope of the upper side 50 of the channel 28 in the connector 10.

Still referring to FIGS. 1 and 2, the connector has a slot 80 for receiving the conductor 12 therein. In the first preferred embodiment, the slot 80 is a through slot extending from one side 90A of the connector 10 to the other side 90B. In alternate embodiments, the connector receiving slot in the connector may be a partial slot. The slot 80 is located in the lower arm 24 of the connector 10, proximate a front face 92 of the lower arm 24 (see FIG. 2). In the first preferred embodiment, the slot 80 has a generally "C" shaped cross-section adapted to admit the conductor 12 therein. The front face 92 of the lower arm 24 has an opening 84 therein communicating with the "C" shaped cross-section of the slot 80. The opening 84 is sized to exclude the conductor 12 but render the slot 80 sufficiently deformable to crimp the conductor 12 therein, without overly crushing the conductor 12, under compression applied to the external surface 30 and inner surface 34 of the lower arm 24. In alternate embodiments, the conductor receiving slot may have any other suitable shape providing a deformable slot for crimping the conductor therein or be located at another position or orientation on the frame.

Figure 3:
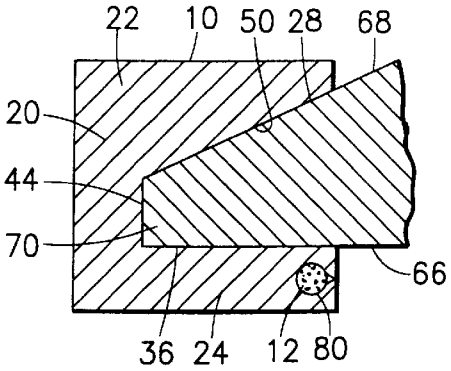
FIG. 3 is a cross-sectional view of the connector shown in FIG. 1 attaching the conductor to the railroad rail.

Referring also to FIG. 3, the railroad rail member 14 is grounded by connecting the connector 10, with the conductor 12 at least partially attached thereto, to the foot flange 60 of the railroad rail member 14. The connector 10 may be attached to either side 72A, B of the foot flange 60. The connector 10 is connected to the railroad rail member 14 by inserting frame 20 onto the toe 70 of the foot flange 60 with the toe 70 being received in the channel 28. Preferably, the foot flange 60 is received into the channel 28 until the toe 70 abuts the bottom 44 of the channel 28. In this position, the slope of the upper side 50 of the channel 28 preferably complements the taper of the foot flange 60 and the lower side 36 of the channel 28 is seated against the lower seating surface 66 of the foot flange 60. The conductor 12 is attached to the connector 1 by inserting the conductor into the slot 80. Once the conductor 12 is located in the slot 80 and the connector 10 is positioned on the foot flange 60, the connector 10 is crimped to the foot flange 60. Crimping is accomplished, preferably by a hydraulic or cartridge driven compression tool, by compressing the upper arm 22 and lower arm 24 inward or towards each other to engage the foot flange 60 inside the channel 28. The upper 22 and lower 24 arms are deformed with sufficient force to generate grip between the upper surface 68 and lower surface 66 of the foot flange 60 and the upper side 50 and lower side 36 of the channel 28 respectively. Hence, the connector 10 is mechanically connected to the railroad rail member 14. As noted above, prior to crimping the connector 10 on the rail member 14, the grounding conductor 12 is inserted into slot 80. The crimping stroke that attaches the connector to the rail 14 also effects electrical and mechanical connection between the connector 10 and the conductor 12. The bearing forces generated during the crimping stroke between the lower seating surface 66 of the foot flange 60 and the lower side 36 of the channel 28 deforms the slot 80 to crimp the conductor 12 therein. Under the bearing forces generated during crimping of the connector 10 onto the foot flange 60, the opening 84 of the "C" shaped slot 80 in the front face 92 of the lower arm 24 is closed. When the slot 80 is closed, the conductor 12 is clamped within the connector 10. Hence, the conductor 12 is mechanically and electrically connected to the connector 10. Consequently, crimping the connector 10 to the foot flange 60 of the railroad rail member 14 establishes both the mechanical and electrical connection between the connector 10 and rail member 14 and the mechanical and electrical connection between the conductor 12 and connector 10. Thus, the conductor 12 is electrically connected to the rail member 14, thereby grounding the rail member 14 to the conductor 12, with only one crimping stroke.

Figure 4:
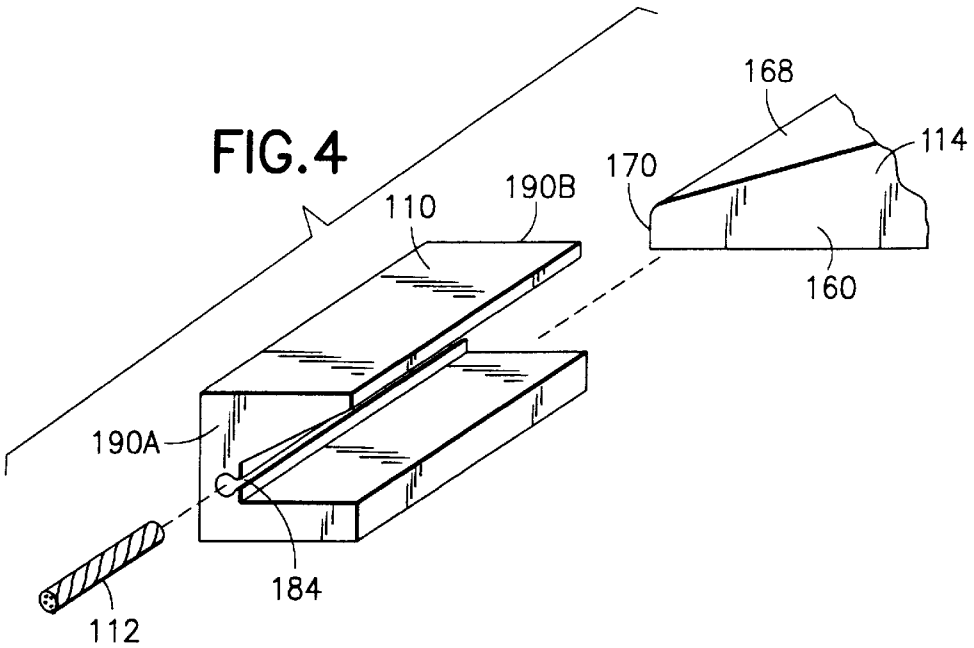
FIG. 4 is an exploded perspective view of a another embodiment of the connector.

Referring now to FIG. 4, there is shown an exploded perspective view of a second preferred embodiment of a connector 110 incorporating features of the present invention. The connector 110 in the second preferred embodiment is substantially similar to the connector 10 in the first preferred embodiment described in FIG. 1. The connector 110 connects a grounding conductor 112 to a railroad rail member 114. The connector 110 is crimped to the railroad rail member 114 mechanically and electrically connecting the connector 110 to the rail member 114. The conductor 112 is clamped to the connector 110 thereby effecting a mechanical and electrical connection therebetween. Hence, the conductor 112 is mechanically and electrically connected to the railroad rail member 114 by the conductor 110. As in the first preferred embodiment, the conductor 112 in the second preferred embodiment is fixedly connected to the contact 110 and thus to the railroad rail member 114 when the connector 110 is crimped to the rail member 114.

Figure 5:
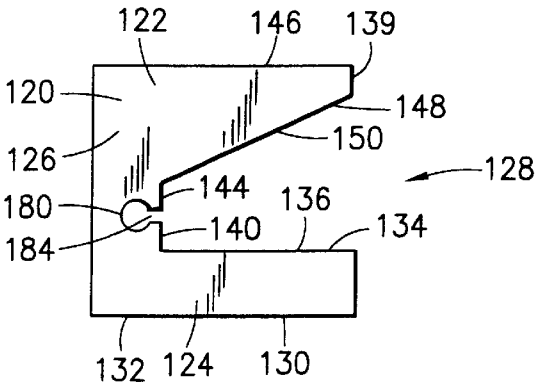
FIG. 5 is an elevation side view of the connector shown in FIG. 4.

Referring also to FIG. 5, in the second preferred embodiment, the connector 110 has a frame 120 made from a ductile electrically conducting metal. The frame 120 has an upper arm 122 and lower arm 124 cantilevered from a web section 126 to form a channel 128. The lower arm 124 is substantially flat. The inner surface 134 of the arm 124 forms a lower side 136 of the channel 128. The outer surface 130 of the arm 124 is the seating surface 132 of the connector 110. The web 126 is substantially perpendicular to the lower arm 124. The inner surface 140 of the web 126 forms the bottom 144 of the channel 128. The upper arm 122 has a tapered cross-section, the outer surface 146 being substantially flat and the inner surface 148 sloping outward from the bottom 144 of the channel 128 to the front 139 of the frame 120. The inner surface 148 of the upper arm 122 forms the upper side 150 of the channel 128. The slope of the upper side 150 of the channel conforms to the slope of the upper surface 168 on the foot flange 160 of the railroad rail member 114. The channel 128 is sized to admit the foot flange 160 of the railroad rail member 114 to the bottom 144 of the channel 128.

The connector 110 in the second preferred embodiment has a conductor receiving slot 180. The slot 180 is located in the web 126 of the frame 120 of the connector 110. In the second preferred embodiment, the slot 180 extends through the frame 120, from one side 190A to the other side 190B (see FIG. 4). The slot 180 has a generally "C" shaped cross-section. The longitudinal opening 184 of the "C" shaped slot is located in the bottom 144 of the channel 128.

Figure 6:
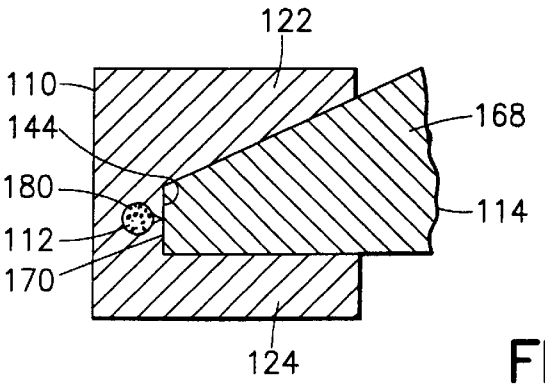
FIG. 6 is a cross-sectional view of the connector shown in FIG. 4; connecting the conductor to the railroad rail

Referring to FIGS. 4 and 6, grounding of the railroad rail member 114 is effected by inserting the connector 110 onto the foot flange 160. The conductor 112 is located in the slot 180. Connection is then completed by crimping the connector 110 to the foot flange 160. The connector 110 is oriented relative to the foot flange 160 so that the taper of the channel 128 complements the taper of the foot flange 160. The foot flange 160 is inserted into the channel 128 until the toe 170 of the flange 160 abuts the bottom 144. The conductor 112 is inserted into the "C" shaped slot 180 of the connector 110. The connector 110 is crimped after the foot flange 160 of the railroad rail member 114 is located in the channel 128 and the conductor 112 is located in the slot 180 of the connector 110. The connector 110 is crimped to the railroad rail member 114 by bending the upper 122 and lower 124 arms inward to engage the foot flange 160 inside the channel 128. As the arms 122, 124 of the connector 110 are bent inward, the bottom 144 of the channel 128 is compressed so that the opening 184 of the "C" shaped slot 180 is closed or substantially closed. The conductor 112 inside the slot 180 is fixedly clamped to the connector 110, when the opening 184 of the slot 180 is closed, thus forming a mechanical and electrical connection with the connector 110. Hence, with only one crimping stroke the conductor 112 is mechanically and electrically connected to the railroad rail member 114 to the conductor 112, thereby grounding the rail member 114, with only one crimping stroke.

Figure 7A:
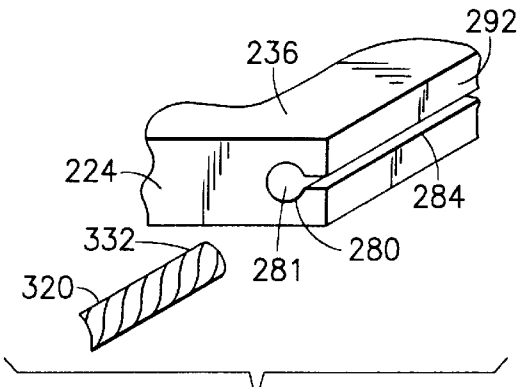
FIG. 7A is a partial perspective view of the lower arm of the connector shown in FIG. 7.
Figure 7:
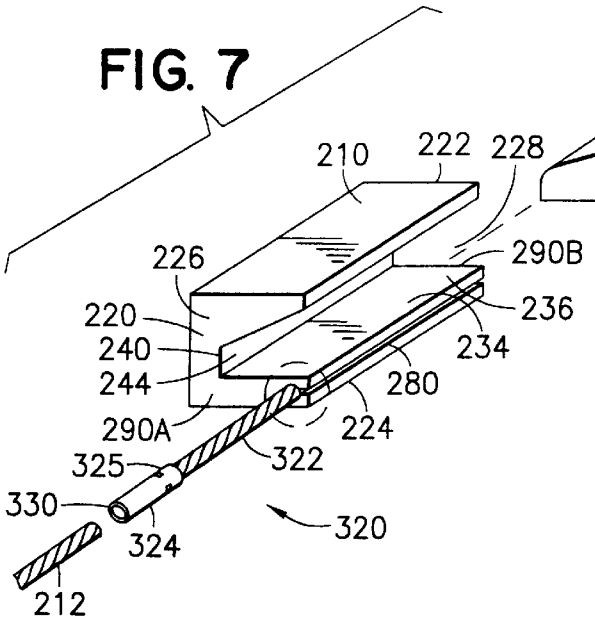
FIG. 7 is an exploded perspective view of another embodiment of the connector for connecting the conductor to the railroad rail.

Referring now to FIG. 7, there is shown an exploded perspective view of a third preferred embodiment of a connector 210 incorporating features of the present invention. The connector 210 connects a grounding conductor 212 to a railroad rail member 214. The grounding conductor 212 is mechanically and electrically connected to the connector 210. The connector 210 is mechanically and electrically connected to the railroad rail member 214. Hence, the conductor 212 is mechanically and electrically connected to the railroad rail member 214, by the connector 210, thereby grounding the railroad rail member 214.

The connector 210, in the third preferred embodiment, comprises a frame 220 and a pigtail 320 attached to the frame 220. The frame 220 is preferably a one-piece member made from a ductile electrically conducting material. The frame has an upper arm 222 and a lower arm 224 cantilevered from a web section or block section 226 to form a channel 228. The lower arm 222 is substantially flat. The inner surface 234 of the lower arm 222 is the lower side 236 of the channel 228. The web 226 is substantially perpendicular to the lower arm 222. The inner surface 240 of the web 226 is the bottom 244 of the channel 228. The upper arm 222, of the frame 220, is tapered giving the channel 228 a taper which complements the taper of the foot flange 260 on the railroad rail member 214. The lower arm 224 has a slot 280 formed therein to receive the pig tail 320. The slot 280 in the third preferred embodiment is a through slot extending from one side 290A to the other side 290B of the frame 220. In an alternate embodiment, the slot may be a partial slot terminating within the lower arm. As shown in FIG. 7A, the slot 280 has a generally "C" shaped cross-section. The longitudinal opening 284 of the slot 280 is located in the front face 292 of the lower arm 224. The pigtail 320 comprises a conducting portion 322 and a terminal splice 324 (see FIG. 7) for connecting to the conductor 212. The conducting portion 322 is a flexible conductor located at the terminal end 325 of the splice 324. In this embodiment, the terminal splice 324 is a compression fitting. The open end 330 of the compression fitting 324 is adapted to admit an end of the conductor 212 therein. In alternate embodiments, the terminal splice may be any suitable means for splicing conductors. For example, the terminal end of the conducting portion 322 may be adapted to be connected to the conductor 212 by a soldered connection or a solderless connection. The proximal end 332 of the conducting portion 322 of the pigtail 320 is located inside the slot 280 in the connector 210. The proximal end 332 of the pigtail 320 is perfunctorily held within the slot 280 by any suitable means such as providing a force fit between the conducting portion 322 and slot 280 or by staking, soldering or welding the pigtail 320 to the frame 220.

Figure 7B:
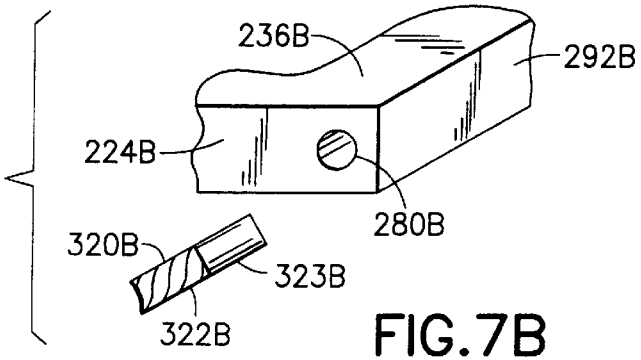
FIG. 7B is a partial perspective view as in FIG. 7A of another alternate embodiment.

FIG. 7B shows another alternate embodiment. In this embodiment the pigtail 320B has a flexible conductor 322B, a splice (not shown) at one end, and a pin 323B at the other end. The connector frame has an enclosed hole 280B in its lower arm 224B. The front face 292B does not have a slot into the hole 280B. The pin 323B can be fixedly and permanently press-fit into the hole 280B before the connector is attached to the railroad rail. In alternate embodiments, other means could alternatively be used to pre-connect the pigtail or another conductor to the connector frame.

Figure 8:
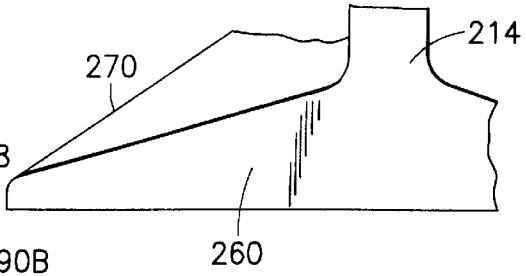
FIG. 8 is a perspective view of the connector shown in FIG. 7 attaching the conductor to the railroad rail.
Figure 8:
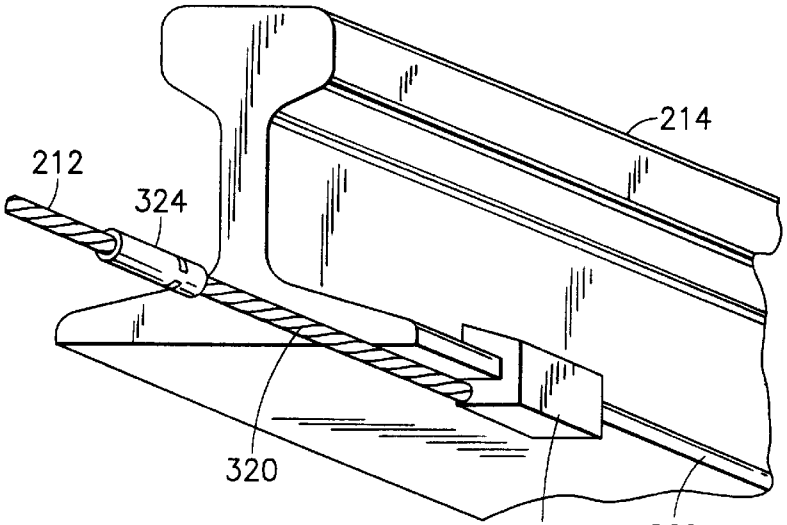

Referring still to FIGS. 7 and 8, the connector 210 is connected to the railroad rail member 214 by inserting the foot flange 260 of the rail member 214 into the channel 228 and then crimping the frame 220 to the foot flange 260. The foot flange 260 is inserted into the channel 228 so that the toe 270 abuts the bottom 244. The frame 220 of the connector 210 is crimped by deforming inward the upper 222 and lower 224 arms to engage the foot flange 260 in the channel 228. Crimping the frame 220 to the foot flange 260 mechanically and electrically connects the connector 210 to the rail member 214. When the frame 220 is crimped onto the foot flange 260, the proximal end 332 of the pigtail 320, located in the slot 280 is crimped therein. The compression forces generated between the foot flange 260 and the lower arm 224 when crimping the frame 220 to the foot flange 260, operate to close the opening 284 of the slot 280. This collapses the "C" shaped slot 280 around the proximal end 332 of the pigtail 320 to crimp the proximal end 332 inside the slot. Crimping the proximal end 332 inside the slot 280 effects a mechanical and electrical connection between the pigtail 320 and frame 220 of the connector 210. The connection between the frame 220 and the pigtail 320 formed when crimping the frame 220 to the rail member 314 is the primary mechanical and electrical connection between the frame 220 and pigtail 320. The crimped connection is a rugged, low loss connection, more effective as a mechanical and electrical connection than the means holding the proximal end 332 of the pigtail 320 in the slot 280 prior to crimping the connector 210 to the railroad rail member 214. Crimping the pigtail 320 within the slot 280 generates high contact pressure between the pigtail 320 and slot surface 281 (see FIG. 7A). The high contact pressure provides a good electrical interface, minimizing the conductive loss between the frame 220 and pigtail 320 of the connector 210. The high contact pressure also generates large friction forces restraining the proximal end 332 within the slot 280 when the connector 210 is subjected to forces tending to dislocate the pigtail 320. The high contact pressure on the pigtail 320 coupled with the long engagement length of the slot 280 extending through the frame 220 provide a connection characterized by good conductivity even under severe vibration associated with railroad rail applications. With the crimped connection being the primary connection between the pigtail 320 and frame 220, the means for holding the pigtail 320 to the frame 220 prior to crimping the connector 210 on the rail. member 214 need only be adequate to merely hold the pigtail 320 to the frame 220 until the connector 210 is crimped. These means need not be capable of resisting dislocating forces on the pigtail 320 or providing good conductivity in the vibratory environment associated with grounding railroad rails. Hence, these means may be superficial and easy to fabricate. The connector 212 may be spliced to the terminal end 325 of the pigtail 320 before or after the connector 210 is crimped to the railroad rail member 214.

The connector 10, 110, 210 in each of the three preferred embodiments of the present invention connects a grounding conductor 12, 112, 212 to a railroad rail member 14, 114, 214 with only a single crimping stroke. The connector 12, 112, 212 of each of the three preferred embodiments of the present invention eliminates the need for welding or brazing the grounding conductor 14, 112, 212 to the railroad rail member 14, 114, 214. Eliminating the welding or brazing of the conductor 12, 112, 212 to the railroad rail member 14, 114, 214, in each of the preferred embodiments, eliminates the need for costly and cumbersome welding or brazing equipment to ground the rail member. Also eliminated with the welding or brazing is the time consuming preparation of the conductor 12, 112, 212 and rail member 14, 114, 214 required to ensure a satisfactory welded or brazed joint. Furthermore, unlike a welded or brazed connection, the connection provided by the connector 10, 110, 210 of the present invention is not subject to fatigue damage induced by vibration of the railroad rail member 14, 114, 214. The crimped connection between connector 10, 110, 210 and rail member 14, 114, 214 and conductor 12, 112, 212 and connector 10, 110, 210 in each of the preferred embodiments of the invention, is well suited to withstand the rigors associated with the railroad rail environment. The railroad rail member 14, 114, 214 is subjected to severe vibration arising from trains rolling on the rail member 14, 114, 214, sometimes at high speeds. Under these conditions, the connector 10, 110, 210 in the preferred embodiments of the present invention, maintains good mechanical contact and electrical interface with the railroad rail member 114, 114, 214 because the foot flange 60, 160, 260 is crimped within the channel 28, 128, 228 which conforms to the taper of the foot flange 60, 160, 260. Hence, both the upper side and lower side of the foot flange 60, 160, 260 contact the channel 28, 128, 228. This contact provides the good electrical interface and generates the friction forces between the flange and channel to prevent movement of the connector 10, 110, 210 when the rail member 14, 114, 214 is subjected to vibration from a rolling train. The connector 10, 110 in the first and second preferred embodiments of the present invention also maintains under vibration good mechanical and electrical contact between the conductor 12, 112 and connector 10, 110. Good contact is maintained due to the high contact pressure and long engagement length provided by crimping the conductor 12, 112, within the slot 80, 180 for the entire length of the connector 10, 110. Similarly, the connector 210 in the third preferred embodiment of the invention maintains good mechanical and electrical contact between the frame 220 of the connector 210 and its pigtail 320. In this third preferred embodiment, the conductor 212 is connected to the connector 210 at the terminal end of the pigtail 320 and not at the frame 220 which is attached to the rail member 214. Hence, the flexible pigtail 320 acts as a vibration break so that the splice between the connector 210 and conductor 212 is not subjected to the vibration of the rail member 214.

In the preferred embodiment of the present invention, the connector 10, 110, 210 connects a grounding conductor 12, 112, 212 to the railroad rail member 14, 114, 214. In alternate embodiments, the connector 10, 110, 210 described in each of the preferred embodiments may be used to connect a signaling, power or communication conductor to the rail member 14, 114, 214. In other alternate embodiments the connector may be modified to connect two or more conductors to the rail member. For example, the connector may have two or more slots for receiving conductors, the slots being closed to crimp conductors located therein when the conductor is crimped to the rail. One slot may be located in the lower arm of the connector, as in FIG. 1, and the other slot may be located in the web of the connector as in FIG. 4. In another example, the connector may have two or more pigtails for connecting to two or more conductors in lieu of the two or more slots.

Figure 9A:
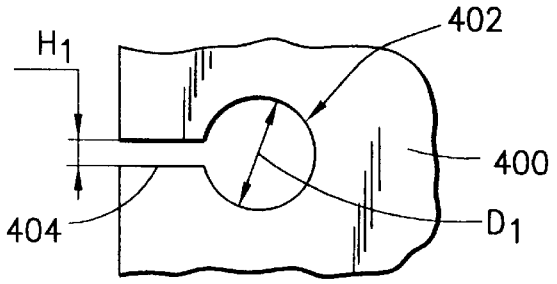
FIG. 9A is a partial end view of a connector showing one embodiment of a conductor receiving area.

Referring now to FIG. 9A, a partial enlarged side end view of a connector 400 is shown. The conductor receiving area 402 has a general circular shape with a diameter $D_1$ and an opening 404 with a height $H_1$. The connector 400 is intended to be used in the telecommunications industry as a means to ground PCS (Personal Communication Service) and cellular radio towers and huts. The connector 400 has a channel (not shown) similar to channel 28 shown in FIG. 1, but with a non-tapered shape. Preferably the size and shape of the conductor receiving area 402 will allow attachment of a #2 or #6 AWG conductor therein. The size and shape of the channel (not shown) is preferably adapted to attach to a rectangular copper busbar. In a preferred embodiment, when the receiving area 402 is intended to receive a #2 AWG conductor, the diameter $D_1$ is about 0.275 inch and the height $H_1$ is about 0.125 inch. However, in alternate embodiments other sizes could be provided. When the receiving area 402 is intended to receive a #6 AWG conductor the diameter $D_1$ is preferably about 0.187 inch and the height $H_1$ is preferably about 1/16 inch.

Figure 9B:
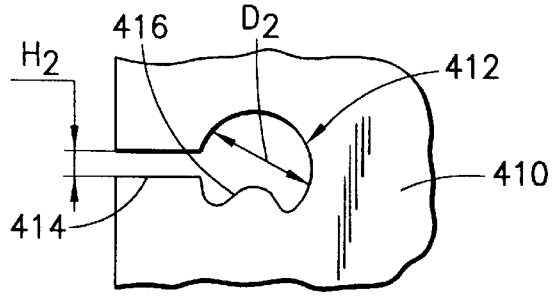
FIG. 9B is a partial end view of a connector showing another embodiment of the conductor receiving area.
Figure 9C:
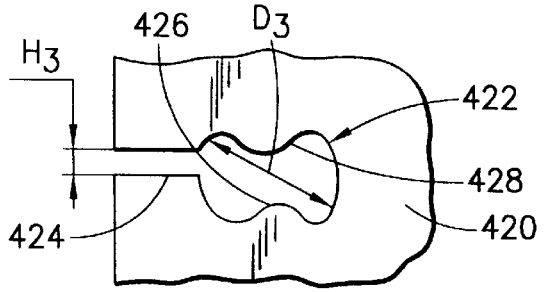
FIG. 9C is a partial end view of a connector showing another embodiment of the conductor receiving area.

Referring also to FIG. 9B, another embodiment is shown. In this embodiment the connector 410 has a conductor receiving area 412 and an opening 414. The area 412 has general diameter $D_2$, but the area 412 includes an indentor 416. The diameter $D_2$ and height $H_2$ would preferably be the same as in FIG. 9A. Referring also to FIG. 9C, another embodiment is shown. The connector 420 has a receiving area 422 with a general diameter $D_3$ and an opening 424 with a height $H_3$ similar to FIGS. 9A and 9B. However, in this embodiment, the area 422 has two indentors 426, 428 on opposite sides of each other. In alternate embodiments, any suitable number, size, shape or orientation of indentors could be provided in the conductor receiving area.

Figure 10:
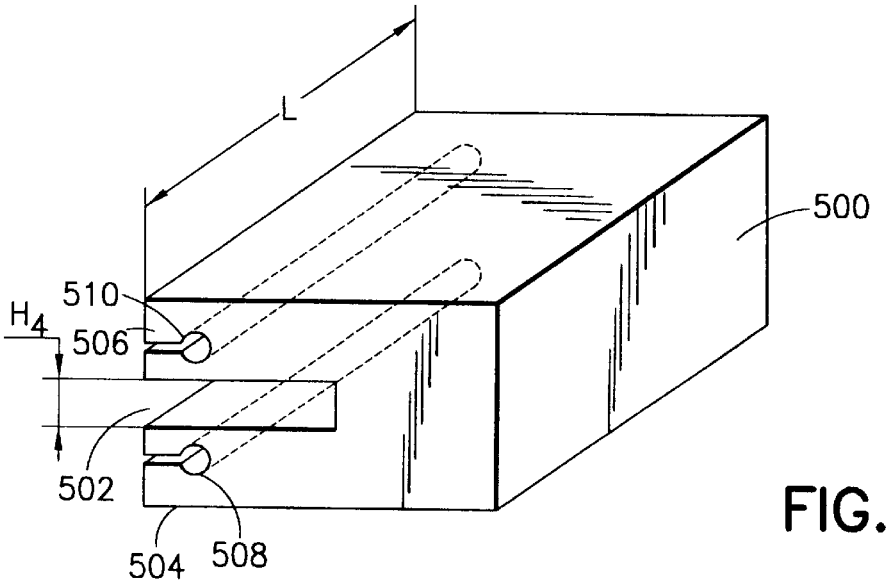
FIG. 10 is a perspective view of an alternate embodiment of the connector.

Referring now to FIG. 10, another alternate embodiment of the connector is shown. In this embodiment the connector 500 has a general rectangular shaped channel 502. The channel 502 is sized and shaped to attach to a rectangular busbar. The two cantilevered arms 504, 506 each have a conductor receiving area 508, 510. In a preferred embodiment, the two areas 508, 510 are sized and shaped to receive two different size conductors, such as a #2 AWG and a #6 AWG. In an alternate embodiment, more than two conductor receiving areas could be provided, a single area could be sized and shaped to receive more than one conductor, a single area could alternatively receive varying numbers of conductors, or a single area could be sized and shaped to receive different size conductors. In a preferred embodiment, the length L of the connector 500 is about 1.5 inch and the height $H_4$ is about 0.25 inch. However, any suitable dimensions could be provided. The two arms 504, 506 are parallel to each other to accept the rectangular copper busbar. Conductors may be fixedly pre-installed in the areas 508, 510 before the connector 500 is attached to the busbar or the conductors could be fixedly attached in the areas 508, 510 during attachment of the connector area 500 to the busbar.

It should be understood that the foregoing description is only illustrative of the invention. Various alternative and modifications can be devices by those skilled in the art without departing from the scope of the invention. Accordingly, the present invention is intended to embrace all such alternative, modifications and variances which fall within the scope of the appended claims.

What is claimed is:

1. In a grounding connector having a frame adapted for clamping to a flange of a structural member, the frame having a general U shape with an upper arm and a lower arm cantilevered from a center section to form opposite sides of the U shaped frame, the opposite sides of the U shaped frame being adapted to clasp therebetween the flange of the structural member when the U shaped frame is clamped to the flange, wherein the improvement comprises:

the U shaped-frame having at least one conductor receiving area to receive a conductor therein, the conductor receiving area being located in one of the opposite sides of the U shaped frame so that when the opposite sides of the U shaped frame are deformed to clasp the flange of the structural member the conductor located in the conductor receiving area is crimped to the U shaped frame.

2. A connector as in claim 1 wherein the conductor receiving area has indentations.

3. A connector as in claim 1 wherein the conductor receiving area is a slot extending through the U shape frame having a longitudinal axis aligned substantially parallel to the U shape frame.

4. A connector as in claim 3 wherein the slot is located in the lower arm, the lower arm having an end surface with a longitudinal opening communicating with the slot.

5. A connector as in claim 3 wherein the slot has a generally "C" shaped cross section.

6. A grounding connector comprising:

a body comprising a block section with a pair of cantilevers extending from the block section, and a conductor pigtail for splicing the body to a conductor, the conductor pigtail having a proximal end located in a recess in the body;

wherein, when the body is crimped to a flange section of a structural member by compressing the cantilevers against the flange section inserted therebetween, the proximal end of the conductor pigtail is crimped within the recess in the body in which the proximal end is located.

7. A grounding connector as in claim 6 wherein the conductor pigtail has at a terminal end means for splicing the conductor pigtail to a main conductor.

8. In a grounding connector having a generally U shaped frame adapted to be clamped to a flange of a structural member, the U shaped frame having an upper arm and a lower arm cantilevered from a center section to form opposite sides of the generally U shaped frame which are adapted to clasp the flange of the structural member located therebetween, wherein the improvement comprises:

the frame having a conductor receiving area to receive a conductor therein, the conductor receiving area being located in the center section of the U shaped frame so that when the opposite sides of the U shaped frame are deformed to clasp the flange of the structural member the conductor located in the conductor receiving area is crimped to the frame and, wherein, one of said opposite sides is angled relative to the other so that the frame has a general funnel shaped cross section.

9. A connector as in claim 8, wherein the funnel shaped cross section of the U shaped frame has a taper which conforms to the flange of the structural member located in the U shaped frame when the frame is crimped onto the flange of said member.

10. A connector as in claim 8 wherein said conductor receiving area is a generally "C" shaped slot extending through the frame having a longitudinal axis aligned substantially parallel to the channel.

* * * * *